US005169070A

United States Patent [19]

Mattson

[11] Patent Number: 5,169,070

[45] Date of Patent: Dec. 8, 1992

[54] AIR DIRECTING RING FOR FLUID SPRAY GUN AIR CAP

[75] Inventor: Roy D. Mattson, White Bear Lake, Minn.

[73] Assignee: Mattson Spray Equipment Company, Inc., Centerville, Minn.

[21] Appl. No.: 718,558

[22] Filed: Jun. 20, 1991

[51] Int. Cl.[5] ..... B05B 7/06; B05B 1/28

[52] U.S. Cl. ..... 239/290; 239/424.5; 239/590; 239/596

[58] Field of Search ..... 239/290, 296, 297, 596, 239/590.3, 590.5, 424, 300, 424.5, 434

[56] References Cited

U.S. PATENT DOCUMENTS

| | | | |
|---|---|---|---|
| 1,660,359 | 2/1928 | Schneider | 239/290 |
| 1,837,861 | 12/1931 | Green et al. | 239/290 |
| 2,126,889 | 8/1938 | Jenkins | 239/290 |
| 2,214,035 | 9/1940 | Tracy | 239/290 |
| 2,904,262 | 9/1959 | Peeps | 239/290 |
| 4,004,733 | 1/1977 | Law | 239/290 |
| 4,501,394 | 2/1985 | Kwok | 239/296 |
| 4,817,872 | 4/1989 | Mattson | 239/300 |
| 4,993,642 | 2/1991 | Hufgard | 239/290 |

FOREIGN PATENT DOCUMENTS

| | | | |
|---|---|---|---|
| 1528571 | 5/1968 | France | 239/290 |

*Primary Examiner*—Kevin P. Shaver
*Assistant Examiner*—Christopher G. Trainor
*Attorney, Agent, or Firm*—Jacobson and Johnson

[57] ABSTRACT

A ring in the path of the low pressure pressurized air that flows to the air cap chamber of a fluid spray gun for atomizing the fluid has a series of circumferentially spaced air passageways angled to direct the pressurized air toward the centrally located atomizing air outlet opening of the air cap to concentrate the atomizing air onto the ejected stream of fluid to produce uniform desired intermediate-sized droplets resulting in improved paint atomizing efficiency.

10 Claims, 1 Drawing Sheet

AIR DIRECTING RING FOR FLUID SPRAY GUN AIR CAP

FIELD OF THE INVENTION

This invention is directed toward an improvement in fluid spray guns, and particularly in paint spray guns, which utilize relatively low pressure air to produce the paint spray. More specifically, the invention is directed toward providing more efficient atomization of the paint as the paint is ejected from the paint or fluid nozzle.

DESCRIPTION OF THE PRIOR ART

A typical prior art paint spray gun utilizing relatively low air pressure is illustrated in U.S. Pat. No. 4,817,872 by Mattson dated Apr. 4, 1989. Conventionally, in paint spray guns at the open end of the spray gun barrel an air cap has a conical chamber for receiving pressurized air which exits a center opening for atomizing the paint. A paint outlet opening from a fluid nozzle is centered with and in close proximity to the atomizing air outlet of the air cap and as the paint is ejected from the nozzle, the atomizing air atomizes the paint. The air cap is also provided with passageways to openings in ears located opposite one another beyond the atomizing air and the paint outlets to apply pressurized air to the atomized paint to form a suitable spray pattern, typically fan-shaped. A primary goal of the paint spraying industry is to produce the best finish with the best paint atomizing efficiency, i.e., the highest degree of paint being deposited on the surface being painted. Stated differently, minimizing the amount of unused or lost paint while producing a uniform and attractive finish. The atomizing efficiency not only results in an economic benefit by making the maximum use out of the paint but also produces an environmental or ecological benefit by reducing the amount of tiny atomized paint particles floating about. In general large size droplets are more likely to be deposited on the surface being painted, thereby increasing atomizing efficiency, but they can produce an unsightly mottled finish. Tiny microscopic droplets will produce a more attractive finish but will create more waste to result in reduced atomizing efficiency.

SUMMARY OF THE INVENTION

Typically, such as described in the aforementioned Mattson '872 patent, an air cap and a fluid nozzle are mounted concentrically in the barrel of the paint spray gun with the fluid outlet opening of the fluid nozzle centered and in close proximity to the air cap atomizing air discharge outlet. Generally pressurized air travels down the barrel of the gun from the upstream end and goes around the fluid nozzle to enter into the air cap chamber. The air then exits out of the air cap chamber through the atomizing air outlet opening of the air cap. In the instant invention a rigid ring member encircles the fluid nozzle and has a number of angled openings or passageways which are angularly spaced from one another around the ring member to direct the pressurized air coming down the barrel of the gun into the air cap chamber at a prescribed or defined angle which directs the air which enters into the air cap chamber toward the atomizing air output opening. As a result the low pressure atomizing air strikes or impacts the fluid stream in a fashion which appears to produce a spray with more uniform desired intermediate droplet sizes so that the paint atomizing efficiency is increased a significant degree while maintaining or even improving the quality of the paint finish. At the same time the size of the fan-shaped spray remains substantially unchanged.

As a further feature, the head of the fluid nozzle snugly yet axially slidably rests in the center opening of the ring member to keep the paint outlet opening of the fluid nozzle centered with the atomizing air outlet opening of the air cap if there is any relative axial movement between the fluid nozzle and the air cap which may occur in regulating or adjusting the paint spray.

DESCRIPTION OF THE PREFERRED EMBODIMENTS

Figure 1:
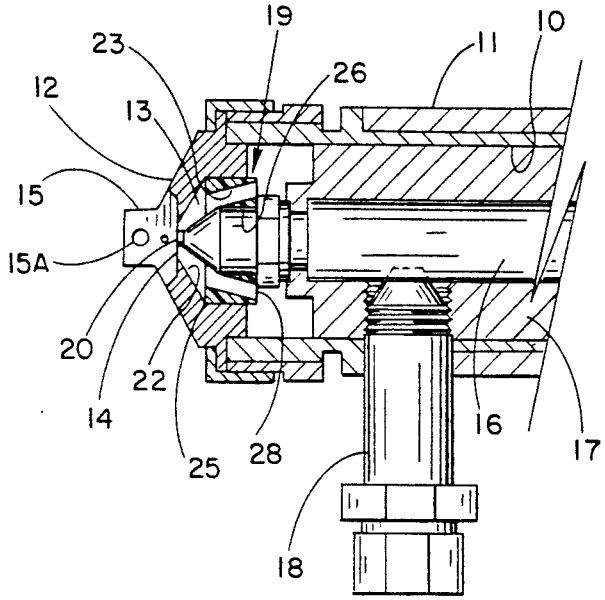
FIG. 1 is a sectioned view taken at the fluid and air outlet end of a fluid spray gun constructed in accordance with the teachings of this invention.
Figure 2:
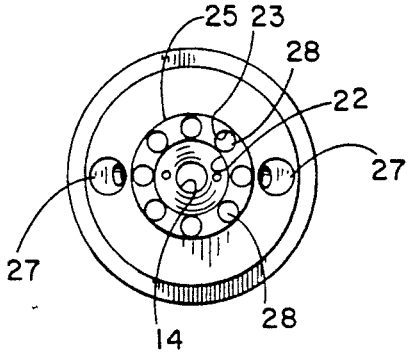
FIG. 2 is a view looking downstream into the air cap chamber with the fluid nozzle removed for clarity.

Conventionally, and as described in greater detail in the aforementioned '872 Mattson patent, pressurized air, preferably of a relatively low pressure in the order of about three to ten psi, flows down the hollow bore 10 of the spray gun barrel 11 to an air cap 12 located at the open end of the barrel. Air enters into an internal air chamber 13 of the air cap and out an outlet or air discharge opening 14 to atomize the fluid, such as paint. Air also flows from the barrel to opposite facing openings 15A in ears 15 on air cap 12 through passageways 27 (FIG. 2), which ears are located downstream from the atomizing air outlet opening 14 so that the air forms the atomized fluid into a suitable spray pattern, for example a fan shape. Generally a cylindrical fluid or paint nozzle 16 is concentrically mounted in bore 10 of barrel 11. Fluid nozzle 16 may be axially slidably mounted in vanes or wings 17 to permit axial movement between the fluid nozzle and the air cap for regulating or adjusting the spray. A fitting 18 carries paint from a suitable source, not shown, radially into the interior of fluid nozzle 16. The downstream end of the fluid nozzle 16 has a head, generally designated by reference numeral 19, which terminates with a paint discharge opening 20 concentric with the atomizing air outlet opening 14 of air cap 12 and located in close proximity thereto. A needle-nosed plunger, not shown for clarity, is operated by a trigger mechanism on the spray gun, also not shown, to open and close fluid outlet opening 20. When fluid is ejected out the opening 20 the atomizing air from the air chamber opening 14 atomizes the paint and the fanning air from ears 15 forms the atomized paint into a suitable spray pattern.

The interior or chamber 13 of air cap 12 is defined by inwardly tapered or conically shaped interior walls 22 which terminate at the downstream end to form the atomizing air outlet opening 14 and at the upstream end at a circular bore 23. A ring 25 is firmly and fixedly seated in bore 23. A cylindrical section of head 19 of fluid nozzle 16 rests snugly but axially slidably in the annular opening 26 of ring 25. This permits longitudinal or axial back and forth movement between air cap 12 and fluid nozzle 16 if necessary to adjust or vary the spray pattern and still retain the fluid exit opening 20 and the atomizing air opening 14 in concentric alignment.

Ring 25 has a series of openings or passageways 28 equally angularly spaced around ring 25 through which the pressurized air enters into air cap chamber 13 from the barrel. Typically, no limitation thereto intended, eight passageways are provided circumferentially spaced at about forty-five degrees. Passageways 28 are angled inwardly, i.e., toward the barrel axis, to direct the flow of the pressurized air from the barrel into the air cap chamber 13 toward the atomizing air outlet opening 14. It has been found that in a low pressure spray gun by concentrating the air flow at the atomizing air outlet opening it strikes the fluid stream in a fashion to produce uniform desired intermediate sized paint droplets resulting in greater paint atomizing efficiency and an attractive finish. As mentioned earlier, the size of the fan-shaped spray remains substantially unaltered so the spray pattern will cover the same surface area. Preferably ring 25 is made of a suitable rigid plastic material such as acetel or nylon, for example, and is press-fitted into bore 23 of air cap 12 so it stays securely in place. Alternatively, ring 25 may be an integral part of air cap 12. For example, air cap 12 may be molded out of plastic with ring 25 an integral molded part. Or if air cap 12 is a machined or cast metal part, ring 25 can still be an integral part of the air cap. The cylindrical portion of the fluid spray nozzle 16 is seated or rests snugly in the center bore 26 of ring 25. If necessary or desired, there can be axial movement between nozzle 16 and air cap 12 to provide an adjustment of the fluid spray pattern.

Figure 3:
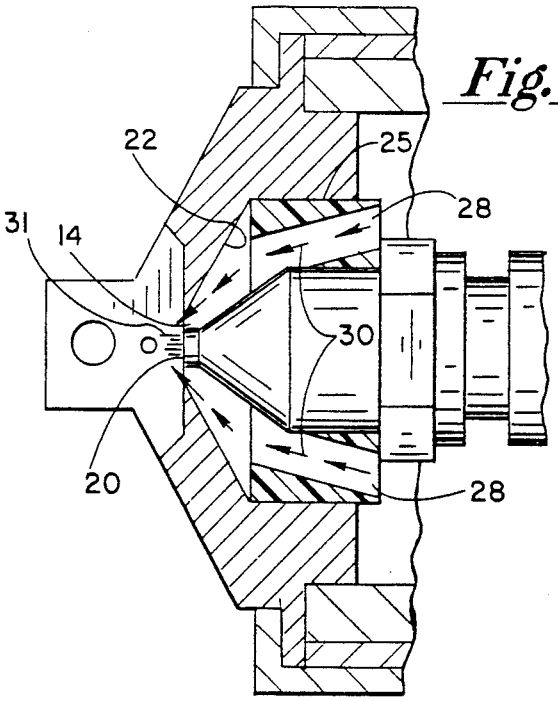
FIG. 3 is a somewhat enlarged cross-section of the air cap diagramatically illustrating the air flow.

FIG. 3 diagramatically illustrates the invention in greater detail. Openings or passageways 28 are preferably circular in cross-section or cylindrical along their length with the centers angled so that the passageways direct the air entering chamber 13 of air cap 12 toward the atomizing air outlet opening 14. The axis or center line of passageways 28 make an angle with the axis or center line of the air cap (generally concentric with the center line of the barrel and the fluid nozzle) which is more acute than the angle that the interior conical wall 22 of the air cap makes with the air cap center line. The air flows generally as shown by arrows 30, concentrated at opening 14. This concentrates the atomizing air to strike or impact fluid stream 31 just beyond or downstream from where it exits from the fluid nozzle through output opening 20 at a location and at an angle which appears to produce generally uniformly sized droplets in the paint spray to result in improved atomizing efficiency while maintaining a high quality finish. In other words, it appears that this arrangement reduces (if not eliminates) the large size droplets which detract from the paint finish and also reduces the number of tiny particles or droplets which float away and do not deposit themselves on the surface being sprayed.

I claim:

1. In a fluid spray gun having an air cap at an exit end of a gun barrel, said cap having a circular bore at its upstream end with a downstream edge of the circular bore joined to a uniformly inwardly tapered conical wall terminating at a central opening for the discharge of fluid atomizing air, and a generally cylindrical fluid nozzle having a fluid discharge opening concentric with the air cap with an annular space between the exterior of the fluid nozzle and the circular bore of the air cap, the improvement comprising:

a ring member in the circular bore of the air cap surrounding the fluid nozzle, said fluid nozzle resting in a central opening of said ring member with the fluid discharge opening in close proximity to the atomizing air discharge opening of the air cap, said ring member having air passageways therethrough angled to aim the streams of pressurized air as they leave the passageways directly at the air cap atomizing air discharge opening to strike the fluid stream in close proximity to the fluid nozzle discharge opening to produce a spray of uniform desirably-sized droplets.

2. The invention as in claim 1 wherein said ring member passageways are equally angularly spaced around the ring member.

3. The invention as in claim 1 wherein said air passageways are cylindrical.

4. The invention as in claim 1 wherein said fluid nozzle is snugly but axially slidably engaged in the central opening of the ring member.

5. The invention as in claim 4 wherein said ring member maintains said fluid nozzle discharge opening concentric with the atomizing air discharge opening of the air cap when said fluid nozzle is moved axially.

6. In a paint spray gun having a barrel with an open end for ejecting air-atomized paint, the improvement comprising:

an air cap mounted at the open end of the gun barrel, said air cap having an air chamber for receiving pressurized air, said chamber comprising a frustoconical section narrowing to an air outlet circular opening concentric with the gun barrel for providing paint-atomizing air;

a generally cylindrical fluid nozzle in said air cap air chamber having an axially centered fluid outlet circular opening at one end in close proximity to said air cap air outlet; and a rigid circular ring member around said fluid nozzle, said ring member having a plurality of equally angularly spaced openings to form the air into separate streams of air flowing into said air cap air chamber, said openings angled inward with respect to the wall of said air chamber toward said fluid outlet to direct the air streams in the chamber to strike the fluid just as it exits the fluid nozzle outlet to atomize the fluid into a uniform spray of uniform desirably-sized droplets.

7. The invention as described in claim 6 wherein said ring member is snugly around said fluid nozzle yet axially movable with respect thereto, said ring member maintaining said fluid nozzle outlet opening concentric with said air cap air outlet opening.

8. In a low pressure pressurized air fluid spray gun having an air cap at an exit end of a gun barrel, said cap having an air chamber defined by a uniformly inwardly tapered conical wall terminating at a central opening for the discharge of fluid-atomizing air and said gun having a fluid nozzle having a fluid discharge opening in close proximity to and concentric with the air cap atomizing air discharge opening for producing a fluid stream, with low pressure pressurized air flowing down the gun barrel around the exterior of the fluid nozzle to the air cap chamber, the improvement comprising;

a ring member surrounding the fluid nozzle, said ring member having a central opening, said fluid nozzle resting in the central opening of the ring member, said ring member having a plurality of equally angularly spaced air passageways therethrough for forming the air into separate air streams, said passageways angled for concentrating the flow of said air streams entering the air cap air chamber at the fluid nozzle discharge opening to strike the fluid stream at uniform angles just as the fluid stream exits from the fluid nozzle discharge opening to atomize the fluid into a spray of uniform desirably-sized droplets.

9. The invention as in claim 8 wherein said air passageways are cylindrical.

10. The invention as in claim 8 wherein said fluid nozzle rests snugly but axially slidable in the central opening of the ring member, said ring member keeping said fluid nozzle fluid discharge opening concentric with said air cap air discharge opening.

* * * * *